US006540002B1

(12) United States Patent
Edwards et al.

(10) Patent No.: US 6,540,002 B1
(45) Date of Patent: Apr. 1, 2003

(54) APPARATUS FOR DISPENSING MESH DRYWALL TAPE

(75) Inventors: Toby Edwards; Shane Edwards; Dan B. Pool, all of Phoenix, AZ (US)

(73) Assignee: Equity Earnings Corp., Phoenix, AZ (US)

( * ) Notice: Subject to any disclaimer, the term of this patent is extended or adjusted under 35 U.S.C. 154(b) by 0 days.

(21) Appl. No.: 09/353,844

(22) Filed: Jul. 15, 1999

(51) Int. Cl.[7] ..... B44C 7/06
(52) U.S. Cl. ..... 156/577; 156/574; 156/579
(58) Field of Search ..... 156/574, 577, 156/579

(56) References Cited

U.S. PATENT DOCUMENTS

| | | | | | |
|---|---|---|---|---|---|
| 3,785,901 | A | | 1/1974 | Fritzinger | |
| 3,880,701 | A | | 4/1975 | Moree | |
| 3,951,726 | A | * | 4/1976 | Found | 156/527 |
| 3,960,643 | A | | 6/1976 | Dargitz et al. | |
| 3,968,001 | A | | 7/1976 | Lockwood | |
| 4,086,121 | A | | 4/1978 | Ames | |
| 4,197,624 | A | | 4/1980 | Lass | |
| 4,208,239 | A | | 6/1980 | Lass | |
| 4,253,905 | A | * | 3/1981 | Regan | 156/523 |
| 4,406,730 | A | | 9/1983 | Altmix | |
| 4,511,427 | A | * | 4/1985 | Karliner et al. | 156/523 |
| 4,652,331 | A | | 3/1987 | Plasencia | |
| 4,707,202 | A | | 11/1987 | Sweeny | |
| 4,762,586 | A | * | 8/1988 | Wilkie | 156/527 |
| 4,826,557 | A | | 5/1989 | Fu et al. | |
| 4,826,562 | A | | 5/1989 | Ehlis | |
| 5,013,389 | A | | 5/1991 | Retti | |
| 5,073,228 | A | | 12/1991 | Lin | |
| 5,342,466 | A | | 8/1994 | Eidson | |
| 5,456,792 | A | * | 10/1995 | Rodriguez et al. | 156/577 |
| 5,478,000 | A | * | 12/1995 | Jensen | 225/93 |
| 5,814,184 | A | | 9/1998 | Denkins | |

* cited by examiner

*Primary Examiner*—Richard Crispino
*Assistant Examiner*—Cheryl N. Hawkins
(74) *Attorney, Agent, or Firm*—Parsons & Goltry; Robert A. Parsons; Michael W. Goltry

(57) ABSTRACT

Mesh drywall tape dispensing apparatus includes a chassis with a pistol grip for one-hand operation, a tape reel, a tape guide roller mounted within the chassis, and a tape pressure roller mounted adjacent a front end of the chassis. A tape cutter trigger assembly is mounted within the chassis by the pivot pin of the guide roller and movable into a cutting position. The cutter includes a serrated knife edge directed away from the pressure roller at an acute angle to the tape extending from the guide roller to the pressure roller. A corner roller is pivotally mounted on the chassis for movement into a tape engaging position. The pistol grip and the tape reel are mounted on opposite sides of the chassis and adjacent a rear end with the pressure roller mounted adjacent the front end so that the apparatus is generally bounded by a first plane tangent to the pressure roller and bounding a tape roll on the reel and the corner roller therein and a second plane tangent to the pressure roller and the handle. The first and second planes form an angle of less than ninety degrees.

4 Claims, 10 Drawing Sheets

APPARATUS FOR DISPENSING MESH DRYWALL TAPE

FIELD OF THE INVENTION

This invention relates generally to tape dispensing apparatus and, more particularly, to improved apparatus for dispensing mesh drywall tape.

BACKGROUND OF THE INVENTION

Drywall installation is very labor intensive. In fact, more than half the cost of installing drywall is borne by labor. One of the most labor-intensive steps in drywall installation is the patching of the seams separating adjacent drywall panels. This process normally involves applying a layer of tape over the seams and then sealing the tape with a suitable drywall compound. The application of the tape over the seams proves especially difficult because the seams can prove challenging to reach, and workers find it difficult to cut the tape to desired lengths. Although various devices have been constructed to enhance the ease and efficiency of applying tape to the seams separating adjacent drywall panels, they are difficult to construct and workers find them messy, difficult to clean and cumbersome. These and other disadvantages with known devices therefore necessitate certain new and useful improvements.

Further, most of the drywall tape dispensing devices presently on the market are extremely large and cumbersome, which also makes them expensive and generally only procurable by large contractors and the like. These large devices require an operator to use both hands in the operation and are invariably difficult to use in tight places and near corners and the like (e.g. at the juncture of the wall and the floor or ceiling. Also, at the present time mesh tape is being used in more places because of its additional strength and adherence. However, mesh tape is more difficult to work with for the same reasons that make it more desirable to use.

Accordingly, it would be highly desirable to provide improved apparatus for dispensing and applying tape to drywall and, more particularly, improved apparatus and methods for dispensing and applying mesh tape to drywall It is a purpose of the present invention to provide new and improved apparatus for dispensing drywall tape that is handheld and easy to use.

It is another purpose of the present invention to provide new and improved apparatus for dispensing drywall tape that is compact and can be used in tight areas.

It is still another purpose of the present invention to provide new and improved apparatus for dispensing mesh tape for drywall applications.

It is yet still another provision of the present invention to substantially reduce the equipment investment normally associated with patching the seams separating adjacent drywall panels.

SUMMARY OF THE INVENTION

The above problems and others are at least partially solved and the above purposes and others are realized in new and improved apparatus for dispensing and applying drywall tape to a surface including a chassis with a handle constructed for one-hand operation, a tape roll receiving reel carried by the chassis for rotation, a tape guide roller mounted within the chassis for receiving tape from the reel and guiding the tape to an outlet from the chassis, a tape applying pressure roller mounted adjacent a front end of the chassis for receiving the tape from the outlet and pressing the tape against a surface to be taped, a tape cutter mounted within the chassis and movable between a stored and a tape cutting position, and a corner roller with an angled surface pivotally mounted on the chassis for movement between a stored position adjacent the chassis and a tape engaging position situated outwardly from the pressure roller so as to receive the tape from the pressure roller.

The new and improved apparatus for dispensing and applying drywall tape is further constructed so that the handle and the tape roll receiving reel are mounted on opposite sides of the chassis and adjacent a rear end with the pressure roller mounted adjacent the front end. The apparatus is generally bounded by a first plane tangent to the pressure roller and to a tape roll on the tape roll receiving reel and a second plane tangent to the pressure roller and the handle with the first and second planes forming an angle of less than ninety degrees, whereby the improved apparatus is compact and can be used in tight areas.

In a preferred embodiment the apparatus includes a tape cutter with a serrated knife edge that is mounted so as to be directed away from the pressure roller and at an acute angle to the tape extending from the tape guide roller to the pressure roller. The acute angle applies tension to the tape already applied to the surface so that the tape is severed cleanly and no wrinkles, etc. develop. In addition to the serrated knife edge cutting mesh tape accurately and cleanly, it is movable into a stored position in which the knife edge is protected to prevent contact with hands and other foreign objects.

BRIEF DESCRIPTION OF THE DRAWINGS

The foregoing and further and more specific objects and advantages of the instant invention will become readily apparent to those skilled in the art from the following detailed description thereof taken in conjunction with the drawings in which.

DETAILED DESCRIPTION OF A PREFERRED EMBODIMENT

Figure 1:
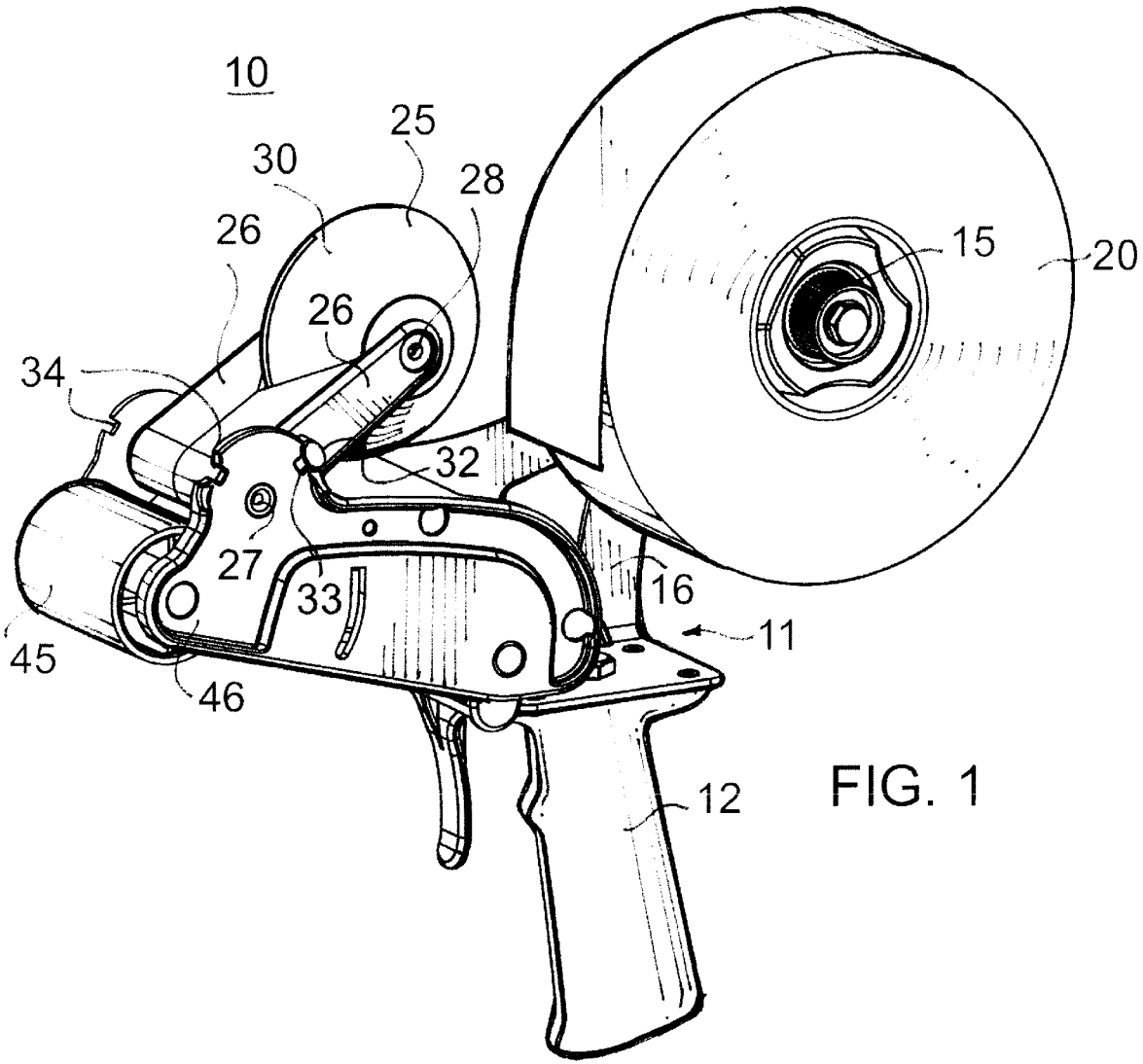
FIG. 1 is an isometric view of drywall tape dispensing apparatus in accordance with the present invention.

Turning now to the drawings, in which like reference characters indicate corresponding elements throughout the several views, attention is first directed to FIG. 1 illustrating an isometric view of apparatus 10 for dispensing drywall tape and especially for dispensing mesh tape. Apparatus 10 includes a chassis 11 having a handle 12 attached thereto for one-hand operation. In this preferred embodiment handle 12 is a pistol-grip type of handle but other types may be convenient for other applications. A tape roll receiving reel 15 is carried by chassis 11 for rotation during dispensing operations. Handle 12 and reel are positioned on opposite sides of chassis 11 and adjacent a rear end 16 thereof, for reasons that will be explained in more detail presently.

Figure 2:
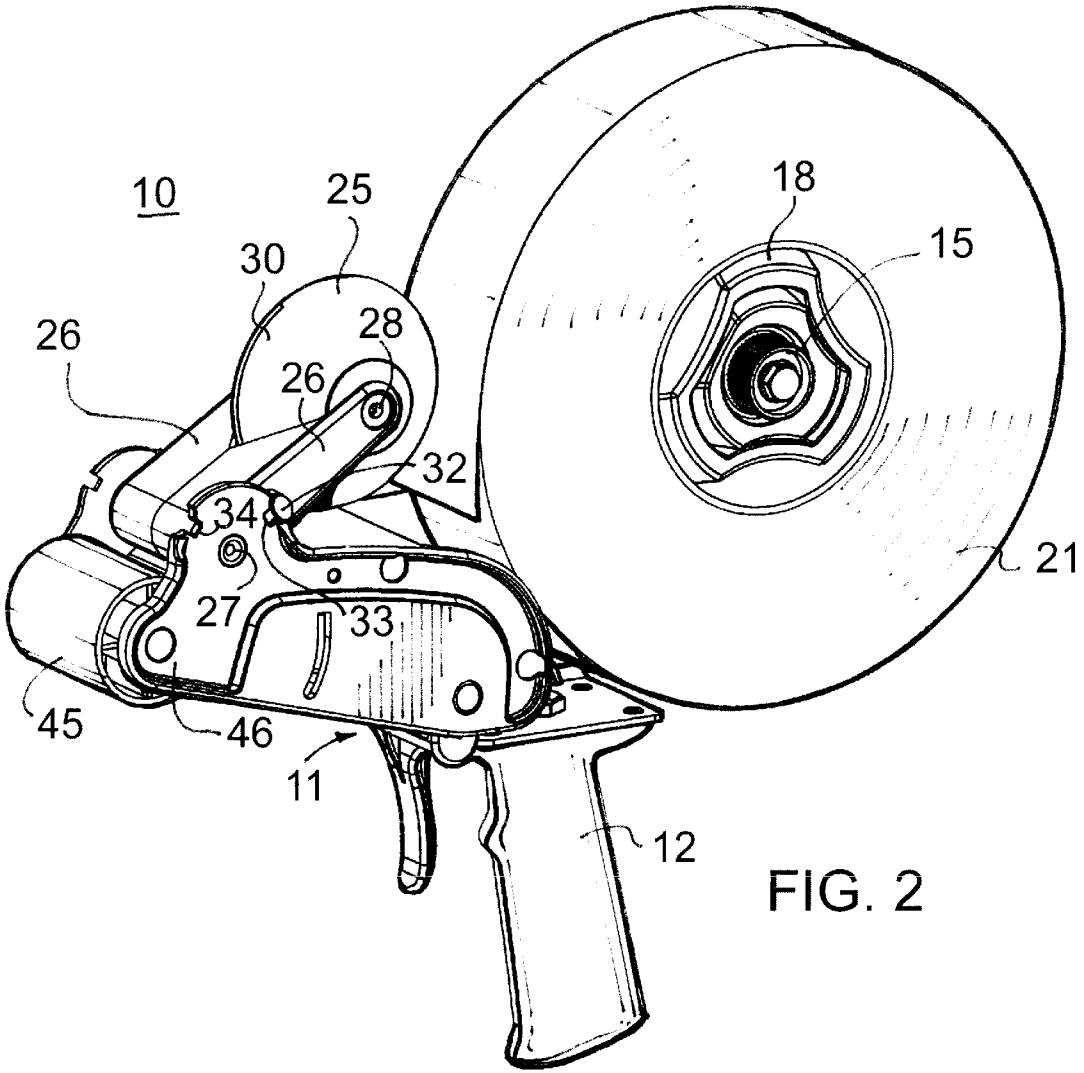
FIG. 2 is an isometric view of the drywall tape dispensing apparatus of FIG. 1 utilizing a tape reel spacer assembly.
Figure 3:
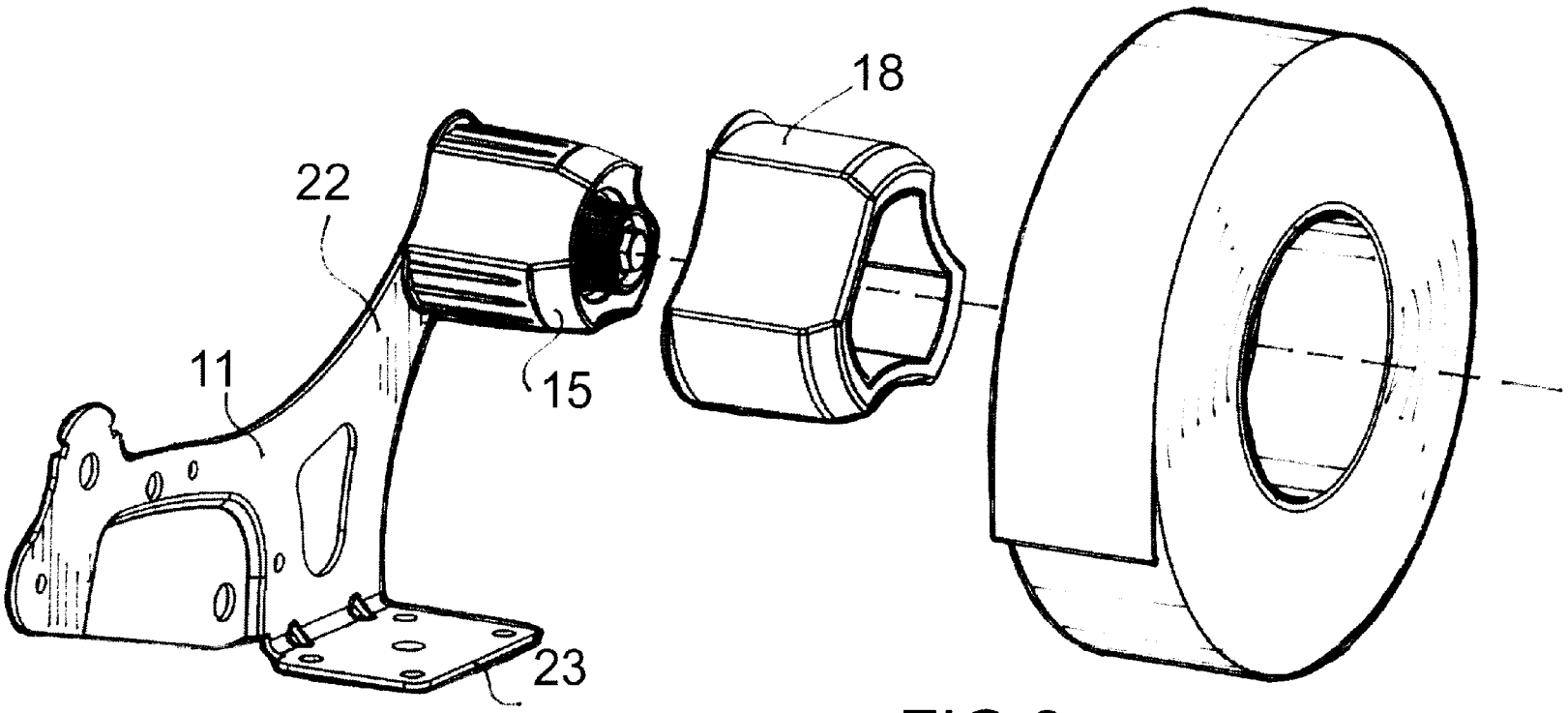
FIG. 3 is an isometric exploded view of a portion of the drywall tape dispensing apparatus of FIG. 1 and the assembly of the tape reel spacer of FIG. 2.

Apparatus 10 is constructed to receive and utilize various sizes of tape rolls, e.g. from a two inch core with 300 foot of tape (illustrated in FIG. 1) to a three inch core with 500 foot of tape (illustrated in FIG. 2). While the apparatus can be constructed to receive different sizes of tape rolls, in this preferred embodiment, reel 15 is constructed to receive a two inch core with 300 foot of tape (tape roll 20 in FIG. 1). By simply installing a spacer 18 coaxially over reel 15, as illustrated in FIGS. 2 and 3, apparatus 10 is ready to receive and dispense a three inch core with 500 foot of tape (tape roll 21 in FIG. 2). Also, in FIG. 3 a portion of chassis 11 can be seen in detail with mounting arm 22 integrally attached and extending rearwardly therefrom. Reel 15 is rotatably mounted at the outer end of mounting arm 22. Further a mounting platform 23 is illustrated as being attached or integrally formed with the portion of chassis 11 illustrated in FIG. 3. Pistol-grip 12 is fixedly attached to mounting platform 23 by any convenient means, such as one or more screws or bolts.

Figure 4:
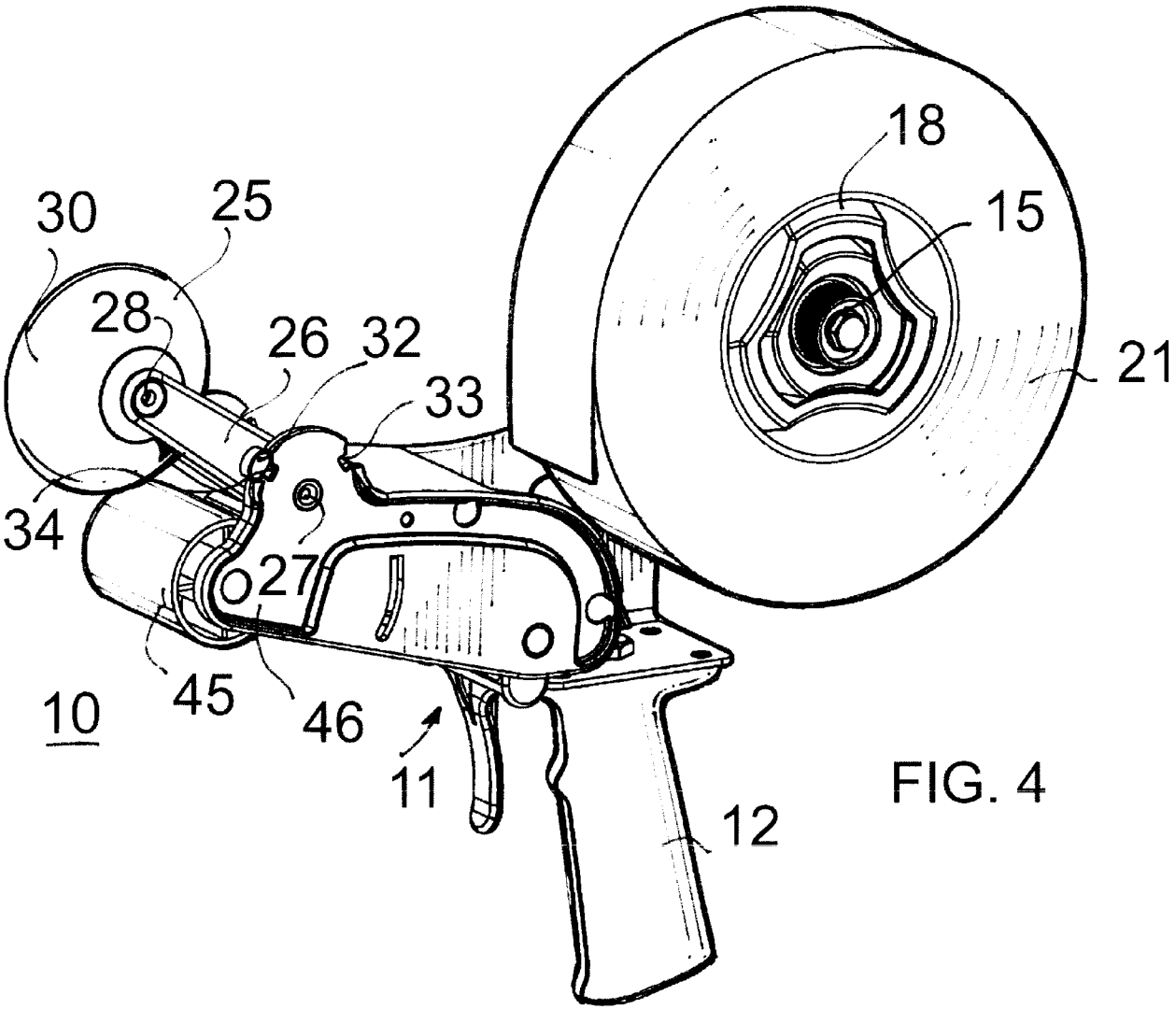
FIG. 4 is an isometric view of the drywall tape dispensing apparatus of FIG. 1 with a corner roller in a tape engaging position.

A corner roller 25 is pivotally attached to chassis 11 by means of a pair of spaced apart arms 26. Arms 26 are fixed together at the lower end (see FIG. 1) and pivotally attached to chassis 11 by a pivot pin 27. Corner roller 25 is positioned between arms 26 at the upper end and rotatably mounted therebetween by means of a pivot pin or axle 28. Corner roller 25 has an angled surface 30, with an apex generally in the center of the periphery and the sides receding axially inwardly to form a substantially 90° angle, which fits conveniently in a corner between walls or the like. Corner roller 25 is pivotally mounted on chassis 11 for movement between a stored position (illustrated in FIG. 1) adjacent chassis 11 and a tape engaging position (illustrated in FIG. 4) situated outwardly from the pressure roller (to be explained presently) so as to receive the tape from the pressure roller. A spring loaded detent 32 (only one is shown) is affixed to extend outwardly from each of the pair of arms 26 and to engage a notch 33 when corner roller 25 is in the stored position, so as to maintain roller 25 in the stored position, and to engage a second notch 34 when corner roller 25 is in the tape engaging position, so as to maintain corner roller 25 in the tape engaging position.

Figure 5:
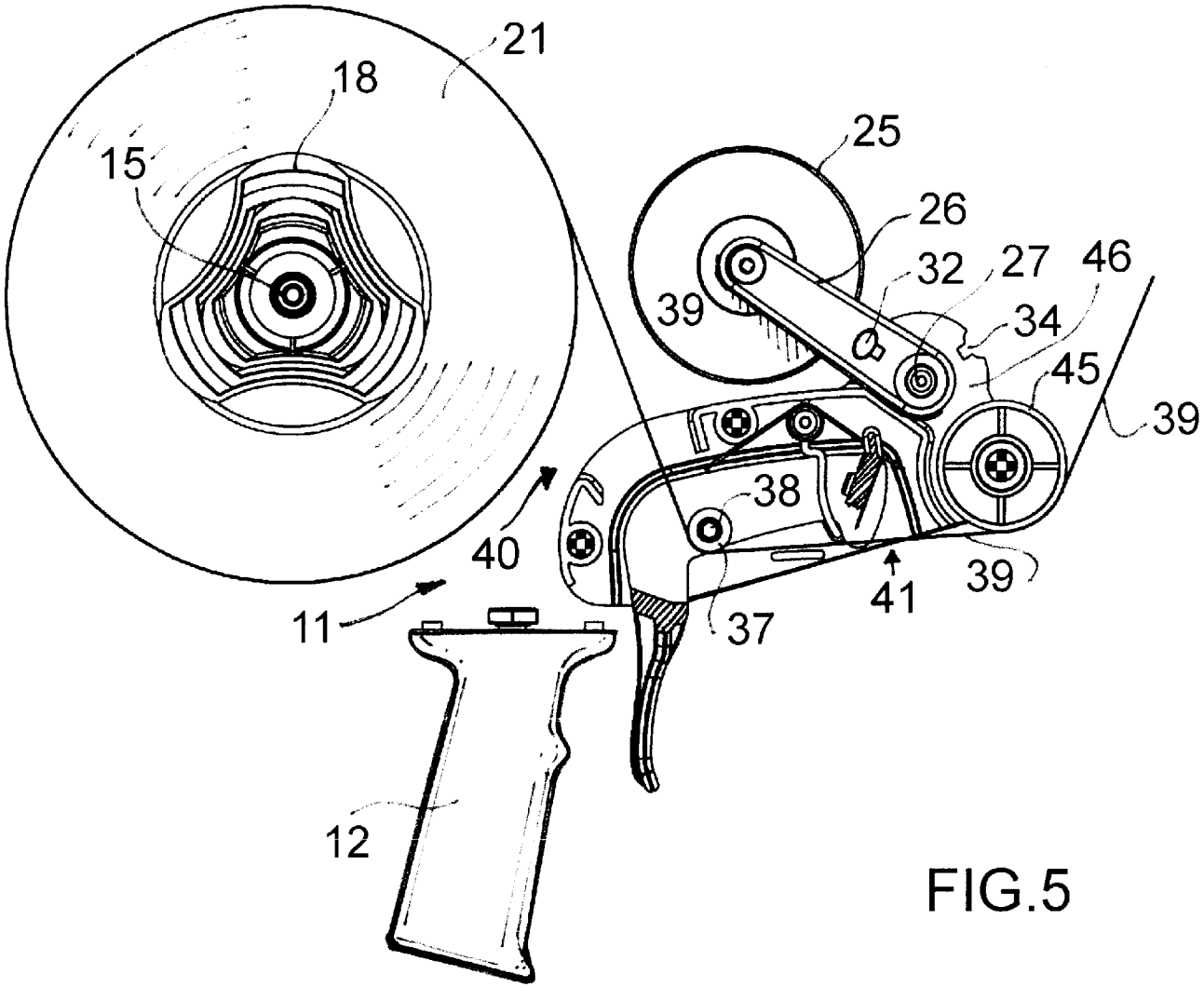
FIG. 5 is a view in side elevation, portions thereof broken away, to illustrate the internal construction of the drywall tape dispensing apparatus of FIG. 1.

Turning now to FIG. 5, a view in side elevation is illustrated, with portions thereof broken away to better show the internal construction of apparatus 10. A tape guide roller 37 is rotatably mounted, by means of a pivot pin or axle 38, within chassis 11 for receiving tape 39 through an inlet 40 from tape role 21 on reel 15 and guiding tape 39 to an outlet 41 from chassis 11. Here it should be noted that tape inlet 40 is constructed very wide so as to make the feeding of tape 39 therethrough during the loading operation very easy and convenient. A tape applying pressure roller 45 is rotatably mounted in chassis 11 adjacent a front end 46 of chassis 11. Pressure roller 45 is positioned to receive tape 39 from guide roller 37 and outlet 41 and press tape 39 against a flat surface to be taped (e.g. a joint between drywall sections, or the like.

Figure 6:
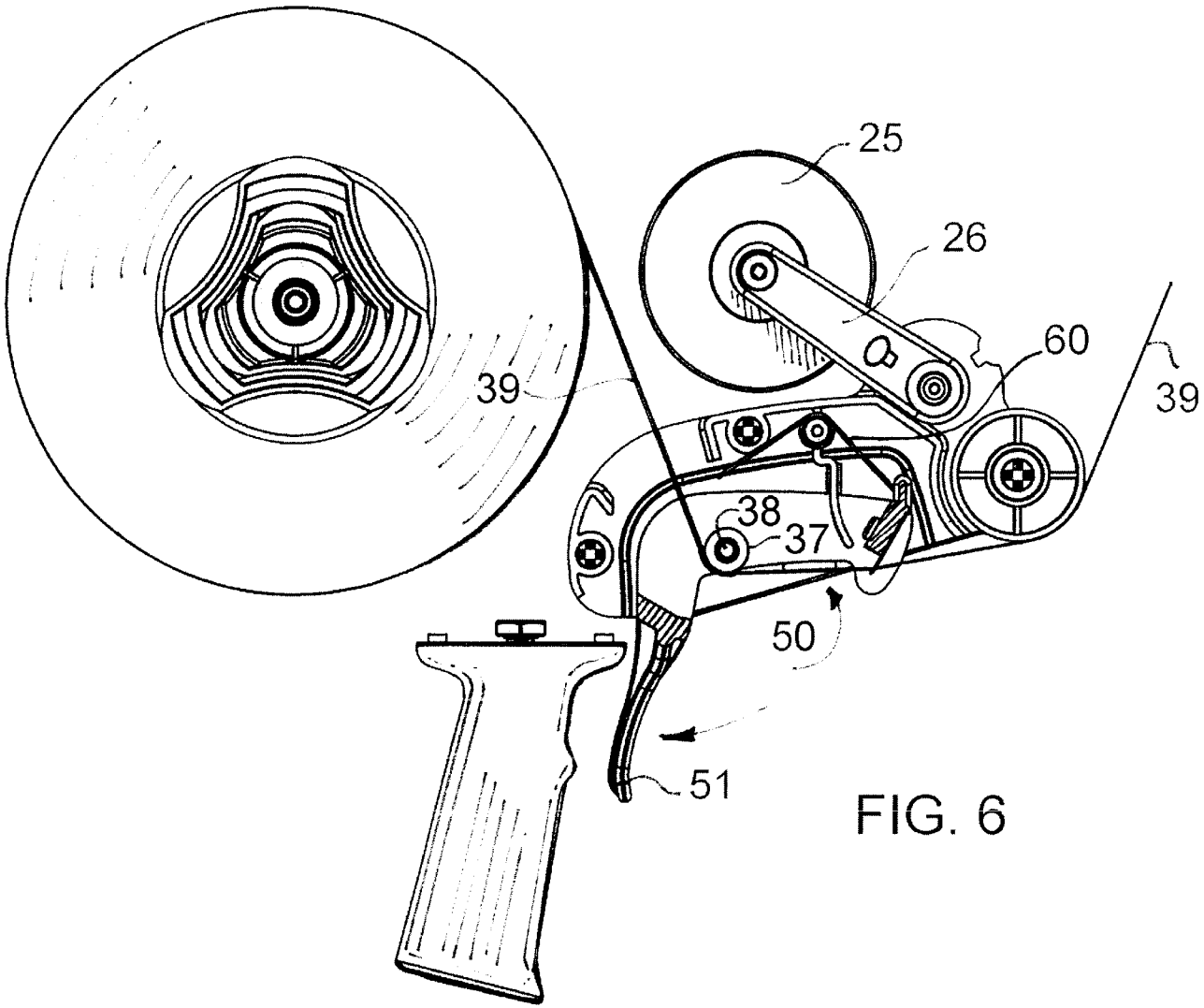
FIG. 6 is a view similar to FIG. 5 with the tape cutter in a tape cutting position.
Figure 7:
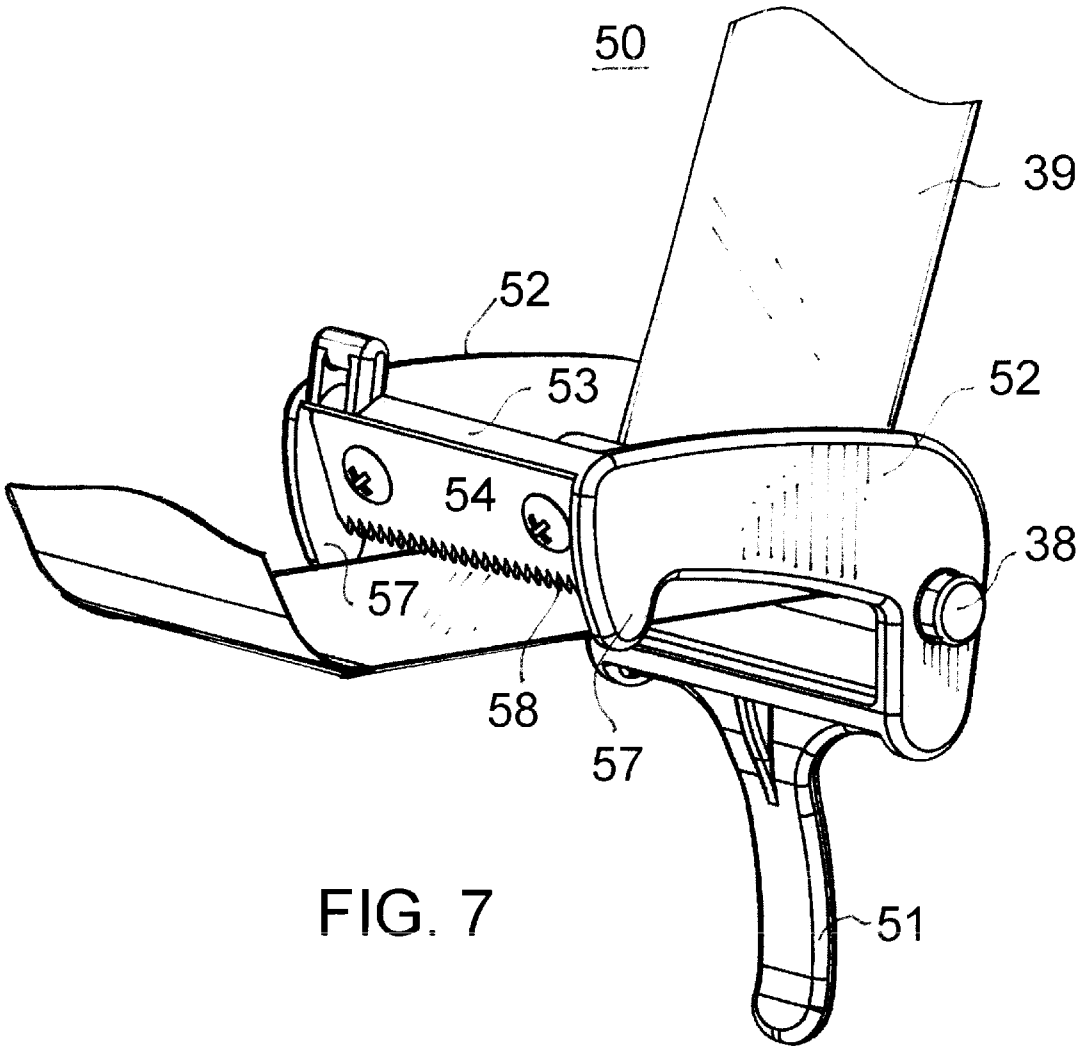
FIG. 7 is an enlarged isometric view of the tape cutter assembly.

Turning now to FIG. 6 a tape cutter assembly 50 is illustrated, in a tape cutting position (assembly 50 is shown in a stored position in FIG. 5). Referring additionally to FIG. 7, tape cutter assembly 50 is illustrated in more detail for convenience in understanding. Assembly 50 includes a trigger 51, which is mounted to extend downwardly adjacent handle 12, and a pair of spaced apart arms fixedly attached to trigger 51. In this embodiment trigger 51 and arms 52 are integrally formed for convenience of manufacture and for strength. A knife blade holder 53 is fixedly mounted between the forwardly projecting ends of arms 52 and a knife blade 54 is attached to holder 53 by any convenient means, such as screws, etc., so as to extend downwardly. Each of the arms 52 has a downwardly extending safety and alignment tab 57 at the forward end thereof, both of which extend downwardly beyond knife blade 54 so as to prevent contact of knife blade 54 with a hand during loading and operating of apparatus 10. In this preferred embodiment knife blade 54 has a serrated edge 58 to aid in cutting fibrous material in mesh tape.

Assembly 50 is pivotally mounted within chassis 11 by means of pivot pin or axle 38, which rotatably mounts tape guide roller 37, as explained above. Axle 38 extends through arms 52 adjacent a rear end thereof so that movement of trigger 51 toward and away from handle 12 causes the forward ends of arms 52, including knife blade 54 and tabs 57, to move generally up and down. A return spring 60 (see, for example, FIG. 6) engages assembly 50 and biases assembly 50 into the upper or stored position, so that when trigger 51 is pulled toward handle 12 the torsion produced by spring 60 is overcome and knife blade 54 moves into the tape cutting position but when trigger 51 is released knife blade 54 automatically returns to the stored position. Here it should be noted that knife blade 54 is directed away from pressure roller 45 and at an acute angle to tape 39 (generally directed rearwardly so as to apply tension to tape 39) extending from tape guide roller 37 to pressure roller 45. Thus, when tape 39 is cut, knife blade 54 causes a tension on the portion of tape 39 already on the flat surface. This tension helps to cut tape 30 accurately and cleanly and to properly place tape 30 on the flat surface and remove any tendency to form wrinkles etc.

Figure 8:
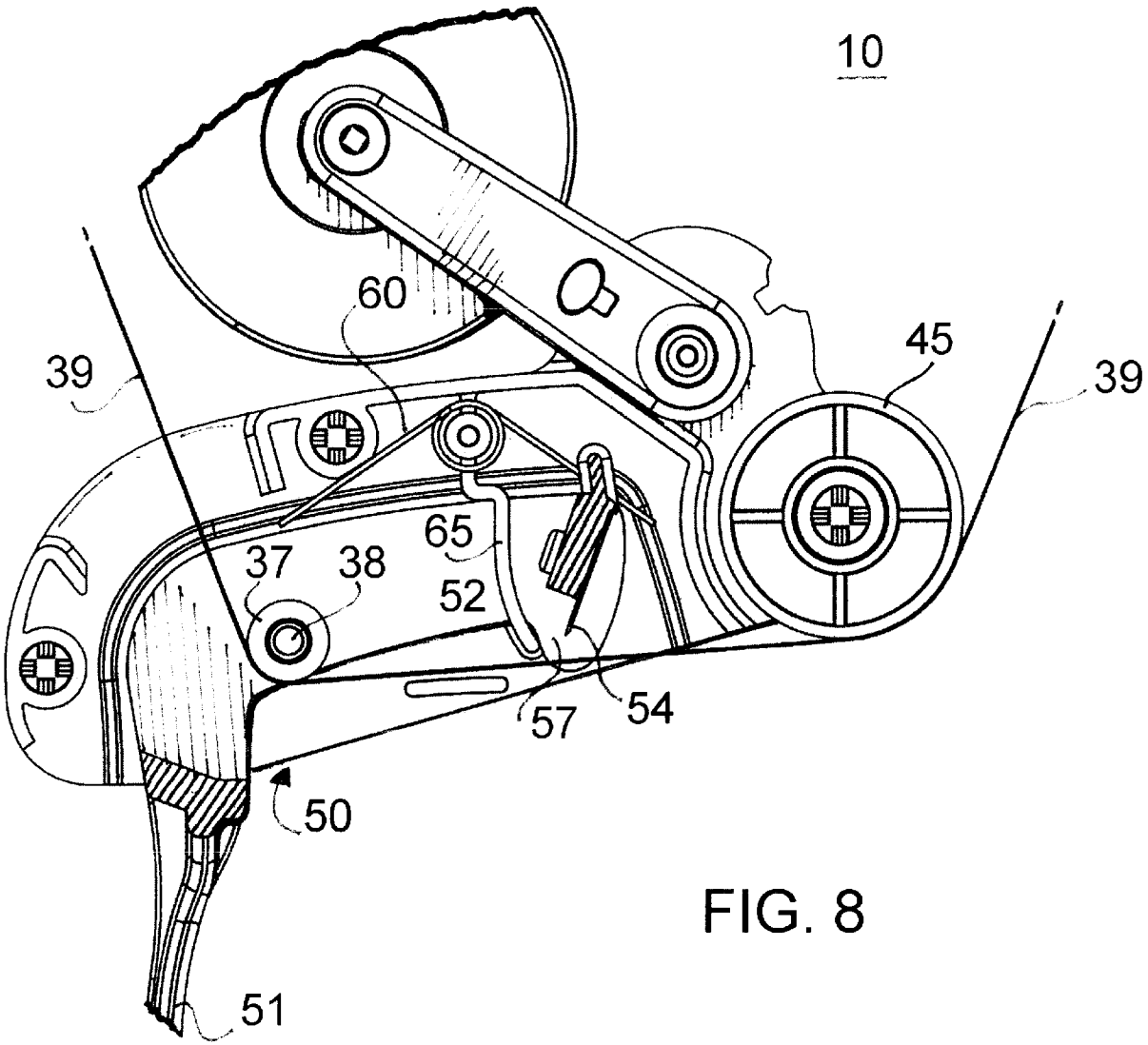
FIGS. 8 and 9 are similar enlarged sectional views of the drywall tape dispensing apparatus of FIG. 1 illustrating the tape cutter in the stored and tape cutting positions, respectively.
Figure 9:
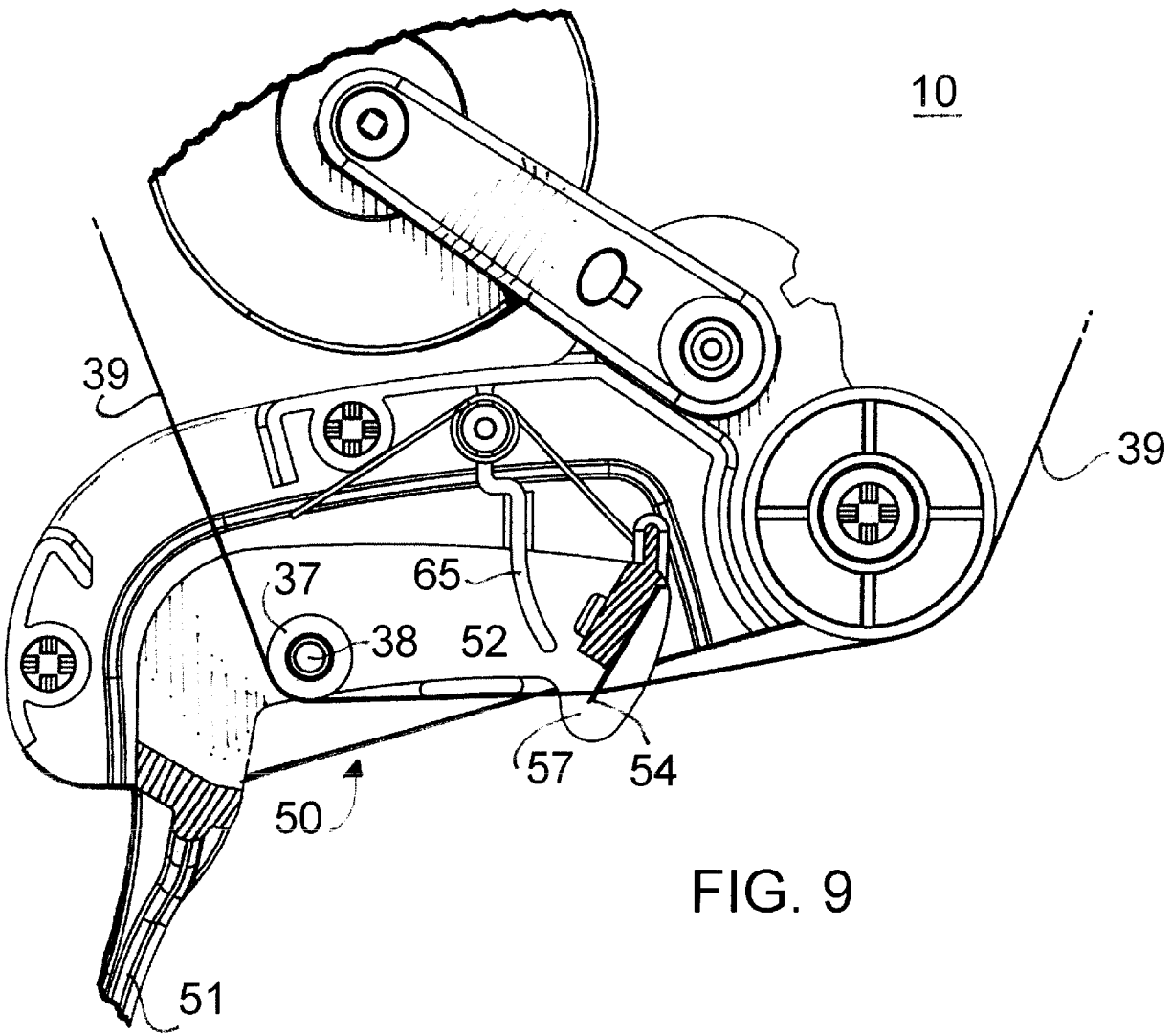

Referring additionally to FIGS. 8 and 9, enlarged views of assembly 10 are illustrated with portions broken away to better illustrate the internal components in clearer detail. For example, FIG. 8 illustrates assembly 50 with knife blade 54 in the stored or protected position and FIG. 9 illustrates assembly 50 rotated so that knife blade 54 is in the tape cutting position. Also, FIGS. 8 and 9 illustrate a protective finger 65 which is fixedly attached to chassis 11 and extends downwardly and slightly forwardly between arms 52. As can be seen in FIG. 8, when knife blade 54 is in the stored position finger 65 extends downwardly and forwardly between arms 52 a sufficient amount to substantially cover knife blade 54 so that an operator cannot inadvertently cut his hand as he threads tape 39 through chassis 11 of assembly 10. Further, as can be seen in FIG. 9, when trigger 51 is pulled to cause assembly 50 to rotate and move knife blade 54 into the cutting position, finger 65 remains in its original position and knife blade 54 moves downwardly beyond it so that it is exposed and can cut tape 39 cleanly and accurately. In addition to protection, finger 65 ensures that paper 39 is pulled free of knife blade 54 for the next taping.

Figure 10:
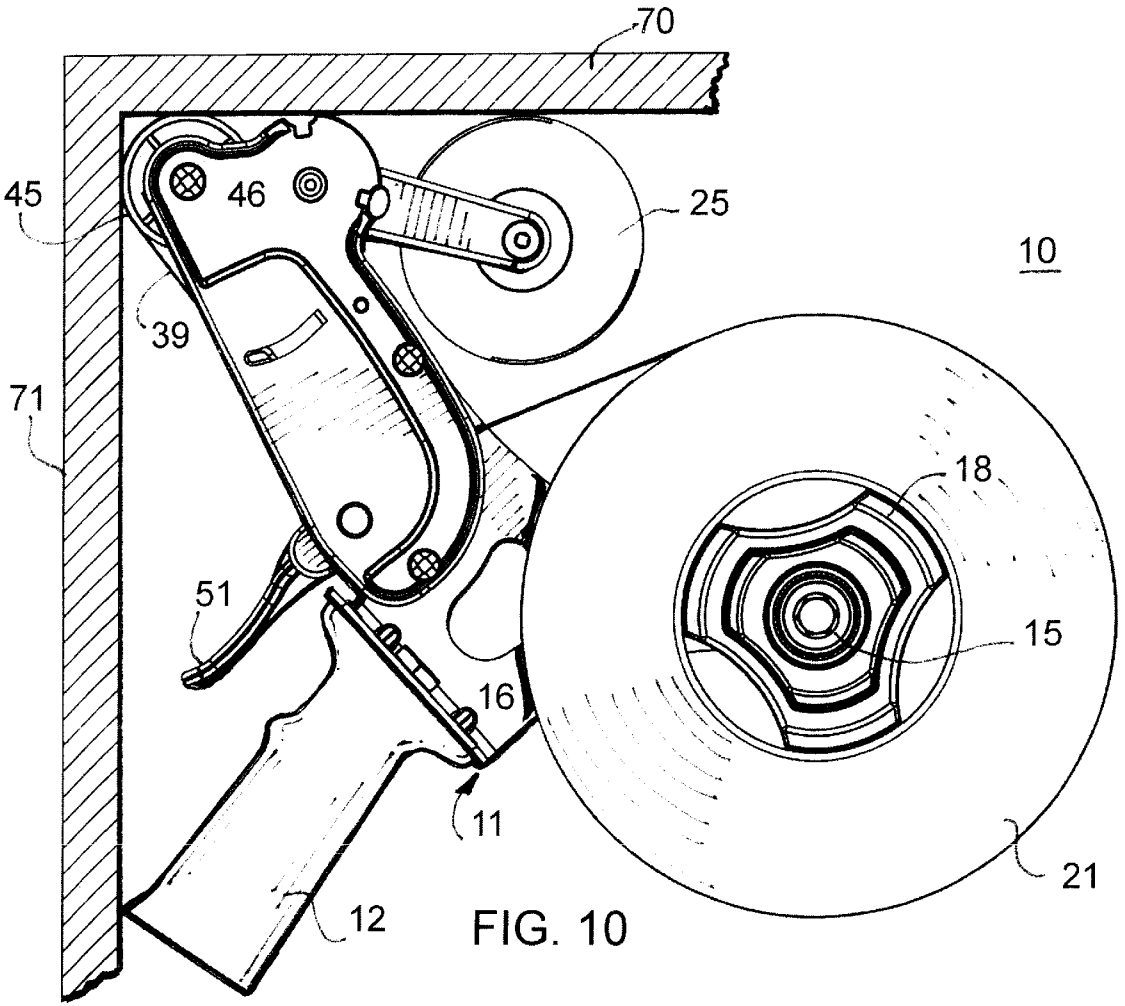
FIG. 10 illustrates the operation of the tape dispenser of FIG. 1 in tight areas.

Turning now to FIG. 10, a view is illustrated of assembly 10 in a typical corner situation during normal taping activity. Assembly 10 is designed and constructed with handle 12 and tape roll receiving reel 15 mounted on opposite sides of chassis 11 and adjacent rear end 16 with pressure roller 45 mounted adjacent front end 46. Because of this novel design, apparatus 10 is generally bounded by a first plane (herein illustrated as wall 70 for convenience) tangent to pressure roller 45 and bounding or outside of tape roll 21 on tape roll receiving reel 15 and corner roller 25 in the stored position, and a second plane (herein illustrated as wall or ceiling 71 for convenience) tangent to pressure roller 45 and handle 12. While first and second planes 70 and 71 are illustrated as walls for convenience it will be noted by those skilled in the art that planes 70 and 71 are actually slightly within the walls so that assembly 10 can travel along wall 70, for examples completely into the corner or juncture of walls 70 and 71. First and second planes 70 and 71 form an angle of less than ninety degrees so that assembly 10 can be conveniently used to dispense and apply tape to a wall, e.g. wall 70, along the entire length and into a corner or junction with another wall, ceiling, floor, etc. Here it should be noted that corner roller 25 comes within (or partially defines) the angle formed by planes 70 and 71 when it is in either of the stored or tape engaging positions.

Thus, new and improved apparatus for dispensing drywall tape has been disclosed which is handheld and easy to use. The new and improved apparatus for dispensing drywall tape is compact and can be used in tight areas, such as corners and the like, to completely tape drywalls even into the junctures of walls with ceilings and floors. Also, the present apparatus is specifically designed for dispensing mesh tape for drywall applications. The apparatus can be adapted for a variety of sizes of tape rolls and is designed to be manufactured very simply and easily so that the cost is minimal to substantially reduce the equipment investment normally associated with patching the seams separating adjacent drywall panels. Thus, the present apparatus is highly versatile and very cost efficient.

The present invention has been described above with reference to a preferred embodiment. However, those skilled in the art will recognize that changes and modifications may be made in the described embodiments without departing from the nature and scope of the present invention. Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. Apparatus for dispensing drywall tape comprising, a chassis including a handle constructed for one-hand operation;

a tape roll receiving reel carried by the chassis for rotation;

a tape guide roller mounted within the chassis for receiving tape from the reel and guiding the tape to an outlet from the chassis;

a tape applying pressure roller mounted adjacent a front end of the chassis for receiving the tape from the outlet and pressing the tape against a surface to be taped;

a tape cutter mounted within the chassis and movable between a stored and a tape cutting position, the tape cutter including a serrated knife edge directed away from the pressure roller, rearwardly toward the handle and at an acute angle to the tape extending from the tape guide roller to the pressure roller; and a corner roller with an angled surface pivotally mounted on the chassis for movement between a stored position adjacent the chassis and a tape engaging position situated outwardly from the pressure roller so as to receive the tape from the pressure roller.

2. Apparatus for dispensing drywall tape comprising, a chassis including a pistol grip handle constructed for one-hand operation;

a tape roll receiving reel carried by the chassis for rotation;

a tape guide roller mounted within the chassis for receiving tape from the reel and guiding the tape to an outlet from the chassis;

a tape applying pressure roller mounted adjacent a front end of the chassis for receiving the tape from the outlet and pressing the tape against a surface to be taped;

a tape cutter mounted within the chassis and movable between a stored and a tape cutting position, the tape cutter including a trigger positioned adjacent the pistol grip handle and included in the one hand operation, the tape cutter being pivotally mounted within the chassis to move with the trigger between the stored and the tape cutting positions, and the tape cutter further includes a spring biasing the tape cutter into the stored position, the tape cutter including a serrated knife edge directed away from the pressure roller and at an acute angle to the tape extending from the tape guide roller to the pressure roller; and a corner roller with an angled surface pivotally mounted on the chassis for movement between a stored position adjacent the chassis and a tape engaging position situated outwardly from the pressure roller so as to receive the tape from the pressure roller.

3. Apparatus for dispensing drywall tape comprising, a chassis including a handle constructed for one-hand operation;

a tape roll receiving reel carried by the chassis for rotation;

a tape guide roller mounted within the chassis for receiving tape from the reel and guiding the tape to an outlet from the chassis;

a tape applying pressure roller mounted adjacent a front end of the chassis for receiving the tape from the outlet and pressing the tape against a surface to be taped;

a tape cutter mounted within the chassis and movable between a stored and a tape cutting position;

a corner roller with an angled surface pivotally mounted on the chassis for movement between a stored position adjacent the chassis and a tape engaging position situated outwardly from the pressure roller so as to receive the tape from the pressure roller; and the handle and the tape roll receiving reel are mounted on opposite sides of the chassis and adjacent a rear end with the pressure roller mounted adjacent the front end so that the apparatus is generally bounded by a first plane tangent to the pressure roller and the corner roller in the stored position and a second plane tangent to the pressure roller and the handle, and the first and second planes form an angle of less than ninety degrees.

4. Apparatus for dispensing drywall tape comprising:

a chassis including a pistol grip handle constructed for one-hand operation;

a tape roll receiving reel carried by the chassis for rotation;

a tape guide roller mounted within the chassis for receiving tape from the reel and guiding the tape to an outlet from the chassis;

a tape applying pressure roller mounted adjacent a front end of the chassis for receiving the tape from the outlet and pressing the tape against a surface to be taped;

a tape cutter mounted within the chassis and movable between a stored and a tape cutting position, the tape cutter including a trigger positioned adjacent the pistol grip handle and included in the one hand operation, the tape cutter being pivotally mounted within the chassis to move with the trigger between the stored and the tape cutting positions, and the tape cutter further includes a spring biasing the tape cutter into the stored position;

a corner roller with an angled surface pivotally mounted on the chassis for movement between a stored position adjacent the chassis and a tape engaging position situated outwardly from the pressure roller so as to receive the tape from the pressure roller; and the handle and the tape roll receiving reel are mounted on opposite sides of the chassis and adjacent a rear end with the pressure roller mounted adjacent the front end so that the apparatus is generally bounded by a first plane tangent to the pressure roller and the corner roller in the stored position, and a second plane tangent to the pressure roller and the handle, and the first and second planes form an angle of less than ninety degrees.

* * * * *